United States Patent [19]

Perek

[11] Patent Number: 4,677,444

[45] Date of Patent: Jun. 30, 1987

[54] DEVICE FOR RAISING A MAST

[76] Inventor: Jean P. Perek, 129 rue de lecelles, 59230 St Amand les Eaux, France

[21] Appl. No.: 745,937

[22] Filed: Jun. 18, 1985

[30] Foreign Application Priority Data

Jun. 18, 1984 [FR] France ..... 84 10002

[51] Int. Cl.[4] ..... H01Q 1/12; E04H 12/34

[52] U.S. Cl. ..... 343/882; 52/116; 248/533; 343/915

[58] Field of Search ..... 343/882, 880; 52/116; 248/530, 533; 254/335

[56] References Cited

U.S. PATENT DOCUMENTS

| | | | |
|---|---|---|---|
| 2,512,151 | 6/1950 | Harrison | 248/533 X |
| 3,141,653 | 7/1964 | Jenkins | 52/116 X |
| 3,450,378 | 6/1979 | Cucka | 248/514 |
| 3,977,148 | 8/1976 | Ranini | 52/116 X |
| 4,167,740 | 9/1979 | Shriver | 343/882 |
| 4,226,405 | 10/1980 | Roodt | 254/335 |

FOREIGN PATENT DOCUMENTS

| | | | |
|---|---|---|---|
| 1037063 | 9/1953 | France | 248/533 |
| 0755053 | 8/1956 | United Kingdom | 343/880 |

*Primary Examiner*—Daniel M. Yasich

*Attorney, Agent, or Firm*—Kerkam, Stowell, Kondracki & Clarke

[57] ABSTRACT

The invention relates to a device for raising a mast from a ground lowered position to a raised position at which it is supported on a base. The lower end of the mast is supported on the base by a connecting link comprising an upper fork and a lower fork joined by a link. The lower fork is fixed relative to the mast, but can be articulated with the mast about a mast-raising axis. The upper fork of the connecting link is connected to the lower part of an arm of a lever along a folding axis which axis is orthogonal to the mast-raising axis.

2 Claims, 7 Drawing Figures

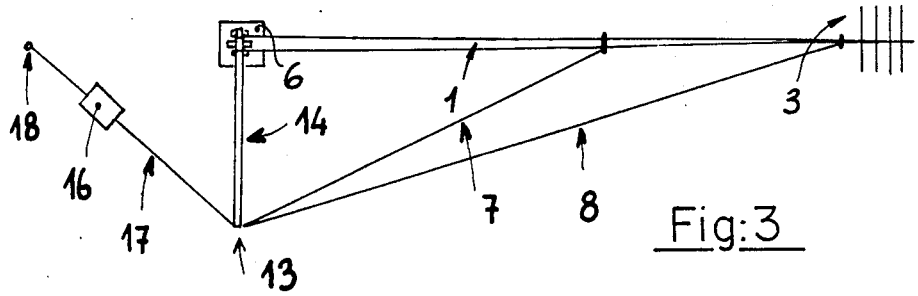
Fig:3
Fig:4
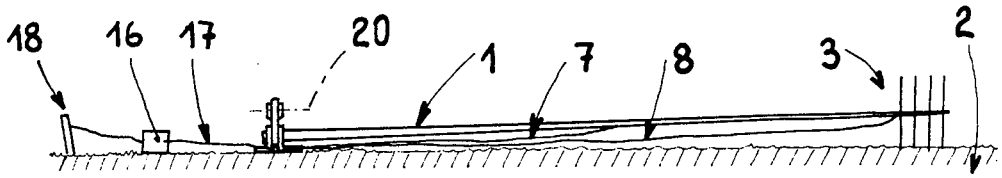
Fig:5
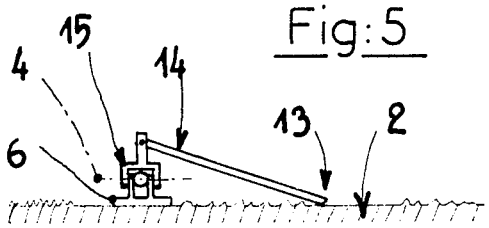
Fig:6
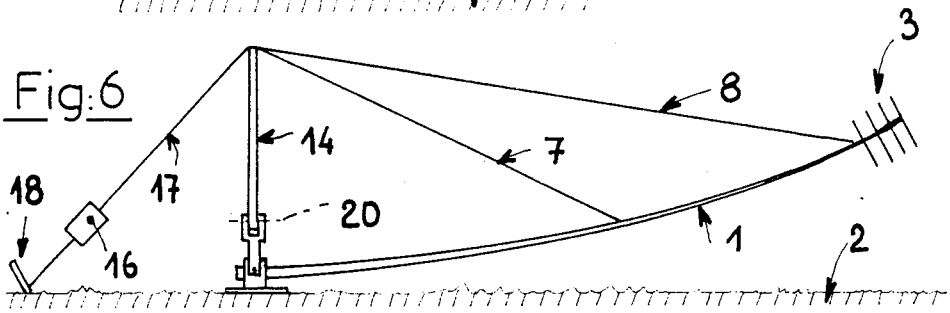
Fig:7
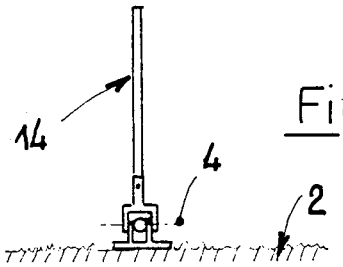

DEVICE FOR RAISING A MAST

RELATED APPLICATIONS

This application is related to the following applications filed concurrently herewith:

1. "Cylindrical Mast Element For End To End Assembly with Other Elements So As To Constitute a Mast", Guy Guislain and Yves Foissac, U.S. Ser. No. 745,934, corresponding to French application No. 84.09.998.

2. "Device For Wind Bracing the Members Of A Lattice Mast and Lattice Mast Provided with Said Devices", Yves Foissac, Guy Guislain, Frederic Ngo and Philippe Bertin, U.S. Ser. No. 745,940, corresponding to French application No. 84.09.999.

3. "Articulation Device Of A Mast And Mast Articulated With This Device", Guy Guislain, U.S. Ser. No. 745,933, corresponding to French application No. 84.10.001.

The subject matter of each of said related applications is hereby incorporated by reference.

FIELD OF THE INVENTION

The present invention relates to a device for raising a mast and to a mast raised with the aid of such a device. It likewise relates to masts provided with this device.

The invention relates more particularly, but not solely, to masts for provisional broadcasting and/or receiving antennas used for either military or civilian purposes.

BACKGROUND OF THE INVENTION

In order to set up transportable provisional antennas and put them into service easily and rapidly, lightweight masts of a composite material, such as fibers associated with a resin, are increasingly being used to support these antennas.

When these masts are used they are kept upright by bracing means.

At the site where it is to be used, the mast is first laid on the ground, so it can be equipped with the antennas and the bracing cables.

Then in order to be raised, the mast is conventionally provided, first, with a collar articulated about a horizontal axis traversing this collar and a shoe anchored in the ground and, second, with at least one cable means fixed near the top of the mast, on which cable means traction is exerted from the base of the mast.

However, at the beginning of this operation, the rigging is substantially parallel to the mast and hence a very large tractional force must be exerted in order to obtain sufficient moment for raising the mast.

To overcome this disadvantage, it is known to associate a lever arm with the collar of the mast, perpendicular to the axis of the mast and in the plane in which the mast will be pulled upward; to the upper end of this arm are attached, first, one of the ends of the cable the other end of which is substantially fixed halfway up the mast and, second, the end of a cable the other end of which is grasped by a traction means such as a winch.

In order to be associated with the collar of the mast, this arm is generally provided at its lower end with a lower fork which laterally covers the mast or its collar and the cap support of its shoe anchored in the ground, so that it can benefit from being pivoted about the same axis as this mast collar when it accompanies the mast as it is pulled upward.

Under the combined effect of the tractional force and the weight of the antennas at the top of the mast, the mast undergoes a deformation which may become permanent, depending on its intensity, or even cause the mast to break.

Furthermore, in order to be effective, a lever arm of this kind must have a considerable length, on the order of several meters, which unfortunately makes the top of the arm quite high and makes it difficult to affix both the cable that is connected to the mast and the cable that is connected to the winch.

OBJECT AND SUMMARY OF THE INVENTION

It is accordingly a principal object of the present invention to obtain a device of the above-described type which facilitates raising a mast by preventing any permanent deformation which may be imposed on by the weight it bears.

Another object of the invention is to obtain a device of the above-described type to which the cables connected to the mast and to the winch can be fixed easily.

To this end, the subject of the invention is a raising device of the above-described type, characterized in particular in that it includes means for allowing the arm of the lever to fold about a folding axis which is orthogonal to the mast-raising axis at the base of this lever. The invention also relates to a mast provided with this device.

The invention will be better understood from the ensuing description of a non-limiting exemplary embodiment, taken in conjunction with the schematic drawings.

BRIEF DESCRIPTION OF THE DRAWINGS

FIGS. 3, 4 and 5 are a plan view, a front view and a profile view, respectively, showing the mast laid on the ground prior to its being drawn up into a curve; and FIGS. 6 and 7 are a front and a profile view, respectively, showing the mast laid on the ground after it has been drawn up into a curve.

DESCRIPTION OF THE PREFERRED EMBODIMENT

Figure 1:
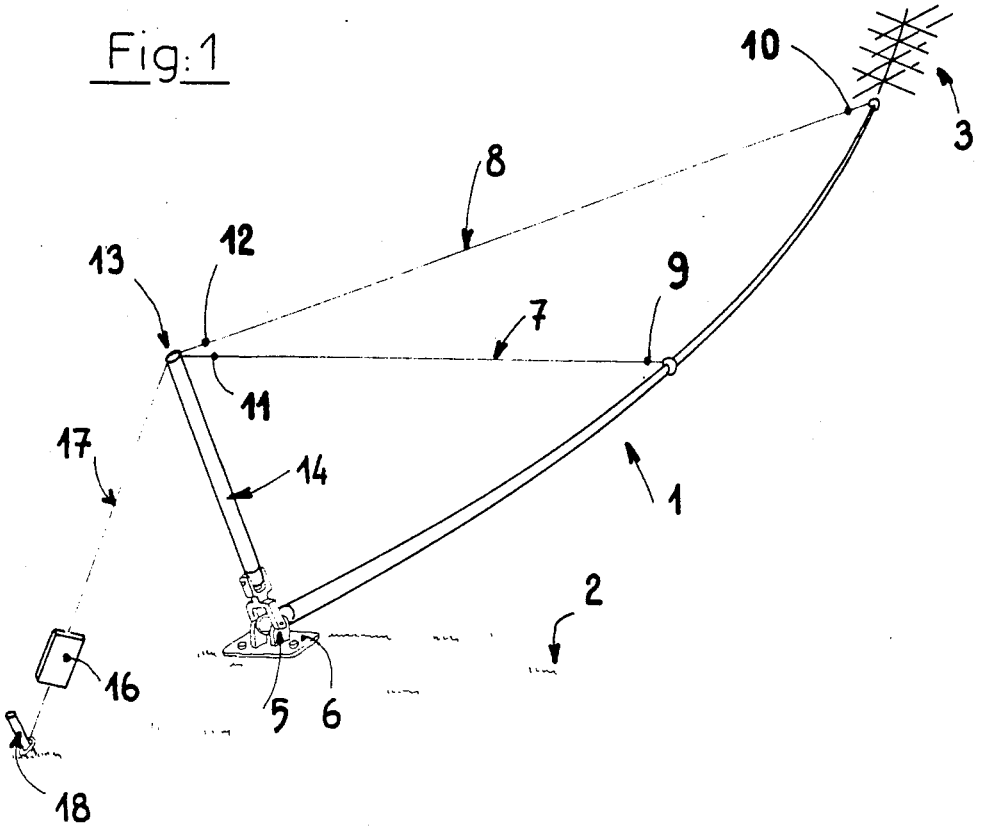
FIG. 1 is a perspective view of a mast erected by means of the device according to the invention.
Figure 2:
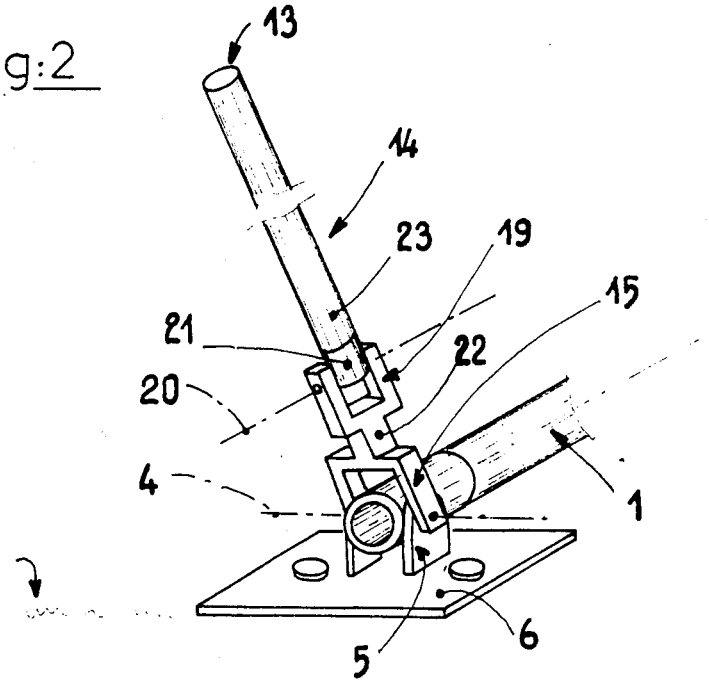
FIG. 2 is a detailed view of the device.

Turning to the drawings, a mast 1 is shown which is initially laid on the ground so as to be equipped with its antenna 3 and joined with a cap support 5 carried by a shoe 6 anchored in the ground 2 in a manner to allow pivoting of mast 1 about axis 4.

To raise the mast from this horizontal position to an upright and vertical position, force is exerted by a lever 14 upon at least one cable 7, 8 which is connected or fixed at one end 9, 10 a certain distance from the base of the mast and which is connected or fixed at its other end 11, 12 at the top 13 of a lever arm 14. Lever arm 14 is perpendicular to the axis of the mast. The base of the lever arm 14 has a lower fork 15 laterally covering the mast such that the lower fork can be pivoted about the mast-raising axis 4 of the cap support 5 of the shoe 6 but is immobilized with respect to the mast.

Generally, the lever is not operated manually, but rather by a means for pivoting the lever and mast comprising traction means such as a winch 16, which with its cable 17 is disposed between the top 13 of the lever 14 and a point 18 of anchorage to the ground located in the lateral extension of the mast and to the side of its base.

Actuating the winch 16 then pulls on the lever causing the lever to begin pivoting about mast-raising axis 4, which aided by the cables 7,8 causes the mast to be pivoted about mast-raising axis 4 into its raised vertical position.

To facilitate access to the top of the lever 14, the lever is assembled to permit pivoting about a folding access 20 which is orthogonal to the mast-raising access 4 at the base of this lever 14.

The lever 14 is divided into two parts including an upper part or arm 23 and a lower part or link 22. Arm 23 is connected via fork 19 extending from intermediate connecting link 22 to the lower fork 15. Fork 15 is connected to cap support 5. The fork 19 having the folding pivot axis 20 is connected to the lower part or arm 23 of lever 14. The base of the lower part 23 has a base piece or pin 21 traversed by the folding axis and the top of the arm receives the cable that is connected to the mast and, if applicable, the cable that is connected to the traction means.

Because of this, during assembly the arm 23 can be folded toward the ground, laterally to the mast 1, which facilitates access to the top of the lever.

The fixation of cables 7, 8 to the top of the lever is preferably accomplished with a slight tension on the cables 7, 8 attached between the mast and the top of the lever.

To prevent dangerous flexion of the mast under the combined influence of traction and weight, the folding axis 20 is located a sufficient distance away from the access 4 of articulation on the shoe 6.

Because of this, before the mast is raised, the straightening of the lever 14 moves its top farther from its base, which tautens the cable connected to the top of the mast and automatically either reinforces or brings about the arching of the mast (FIG. 6).

What is claimed is:

1. A device for raising a mast (1), said mast adapted to be laid on the ground in order to be equipped with an antenna (3), said device having a mast-raising axis (4) provided by a cap support (5) carried by a shoe (6) anchored to the ground (2) (d) said cap support and shoe further supporting the mast, comprising:

a lever (14) extending substantially perpendicularly to an axial direction of the mast, said lever being divided into two parts, a lower part being a link (22), and an upper part being an arm (23), said link having an end which includes a lower fork (15) pivotably connected about said mast-raising axis (4), and another end which includes an upper fork oriented orthogonally to said lower fork, said arm having a base, a top, and a base piece (21) connected to said base and pivotably connected to said upper fork to allow said arm to pivot about a folding axis (20);

at least one cable fixed at one end (9, 10) to the mast at a certain distance away from the base of the mast and fixed at its other end (11, 12) to the top of the arm (23);

means for pivoting said arm and said mast about said mast-raising axis (4), said pivoting means comprising traction means (16) having a traction cable (17) disposed between the top of the arm and a point of anchorage with the ground, said point being located in the axial extension of the mast and on the side of its base.

2. A device according to claim 1 wherein the folding axis (20) is spaced a distance from the mast-raising axis (4) on the shoe (6) to prevent permanent deformation and breaking of the mast.

* * * * *